US007405704B1

(12) United States Patent
Lin et al.

(10) Patent No.: US 7,405,704 B1
(45) Date of Patent: Jul. 29, 2008

(54) INTEGRATED MULTI-BAND ANTENNA

(75) Inventors: Ching-chi Lin, Tu-Cheng (TW); Kai Shih, Tu-Cheng (TW); Yu-yuan Wu, Tu-Cheng (TW); Jia-hung Su, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 10 days.

(21) Appl. No.: 11/699,465

(22) Filed: Jan. 30, 2007

(51) Int. Cl.
*H01Q 1/24* (2006.01)

(52) U.S. Cl. ..... 343/702; 343/700 MS

(58) Field of Classification Search ..... 343/700 MS, 343/702, 846
See application file for complete search history.

(56) References Cited

U.S. PATENT DOCUMENTS 7,289,071 B2 * 10/2007 Hung et al. ..... 343/702
2007/0096999 A1 * 5/2007 Wang et al. ..... 343/702
2007/0120753 A1 * 5/2007 Hung et al. ..... 343/702
2007/0146216 A1 * 6/2007 Wang et al. ..... 343/702
2007/0200774 A1 * 8/2007 Wang et al. ..... 343/702

* cited by examiner

*Primary Examiner*—Hoang V Nguyen
(74) *Attorney, Agent, or Firm*—Rosenberg, Klein & Lee

(57) ABSTRACT

An integrated multi-band antenna has a first radiating element and a second radiating element. The first radiating element has a slot and a feeding conductor having a first feeding point. A first ground portion is arranged to close to the feeding conductor. The second radiating element has a first radiating segment, a second radiating segment extending from one end of the first radiating segment, a third, a fourth, a fifth and a sixth radiating segments connecting end to end in sequence wherein one end of the third radiating segment connects to the other end of the first radiating segment, and one end of the sixth radiating segment remains free. A second feeding point is arranged at the corner between the fourth and fifth radiating segments. A second ground portion is arranged to close to the corner. Operation of the integrated multi-band antenna can obtain various wireless communication bands.

20 Claims, 3 Drawing Sheets

INTEGRATED MULTI-BAND ANTENNA

BACKGROUND OF THE INVENTION

1. Field of the Invention

The invention relates to an integrated multi-band antenna and more specifically, to an integrated multi-band antenna for use in a portable electrical device, especially a notebook.

2. The Related Art

According to the progress of the communication technology, the key development is the transfer from wired to wireless communication, such as the popularization of the wireless household phones, mobile phones and personal digital assistants. In the field of wireless communication, the signal is carriered through invisible electromagnetic wave. Therefore, the bridge between electrical signal and electromagnetic wave is an antenna. So the antenna is certainly needed by a wireless communication device to transmit or receive electromagnetic wave. The antenna is therefore an essential component in the wireless communication device.

A conventional antenna configured in the wireless communication devise can send and receive four bands wireless signal such as GSM850 (Global System for Mobile communications), EGSM (Extended Global System for Mobile communications), DCS1800 (Digital Cellular System) and PCS1900 (Personal Conferencing Specification). It is necessary that an antenna adapting to configure in the wireless communication device operates at various wireless communication bands further comprising W-CDMA2100 (Wideband Code Division Multiple Access), Wi-Fi (Wireless Fidelity).

SUMMARY OF THE INVENTION

An object of the present invention is to provide an integrated multi-band antenna capable of operating at various wireless communication bands.

According to the invention, the integrated multi-band antenna includes a first radiating element and a second radiating element spaced from the first radiating element. The first radiating element defines a first end, a second end, a first edge and a second edge opposite to the first edge. A slot is opened at the second edge of the first radiating element and being extended to the second end of the first radiating element. A feeding conductor with a first feeding point is arranged to close to the opening of the slot. A protrusion is arranged at the first end of the first radiating element and projected from the first edge of the first radiating element. A first ground portion is arranged to close to the feeding conductor.

The second radiating element has a first radiating segment defined opposite sides. A second radiating segment extends from one end of the first radiating segment. A third, a fourth, a fifth and a sixth radiating segments sequentially extend from the other end of the first radiating segment. The second and third radiating segments extend from opposite sides of the first radiating segment. A second feeding point is arranged at where the fourth radiating segment connects the fifth radiating segment. A second ground portion is spaced from the second feeding point.

The first radiating element is divided into a first portion with the slot and a second portion, seen from the feeding conductor. The first portion obtains an electrical resonance length of a quarter wavelength corresponding to a low frequency band including GSM850 and EGSM900 bands. The second portion obtains an electrical resonance length of a quarter wavelength corresponding to a high frequency band including DCS1800, PCS1900 and W-CDMA2100 bands.

The length from the second feeding point to the free end of the second radiating segment of the second radiating element is a quarter of the wavelength corresponding to Wi-Fi2.4 GHz and the length from the second feeding point to the free end of the sixth radiating segment of the second radiating element is a quarter of the wavelength corresponding to Wi-Fi5.2 GHz. Therefore, the integrated multi-band antenna obtains GSM850, EGSM900, DCS1800, PCS1900, W-CDMA2100, Wi-Fi2.4 GHz and Wi-Fi5.2 GHz bands through the first and second radiating elements.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
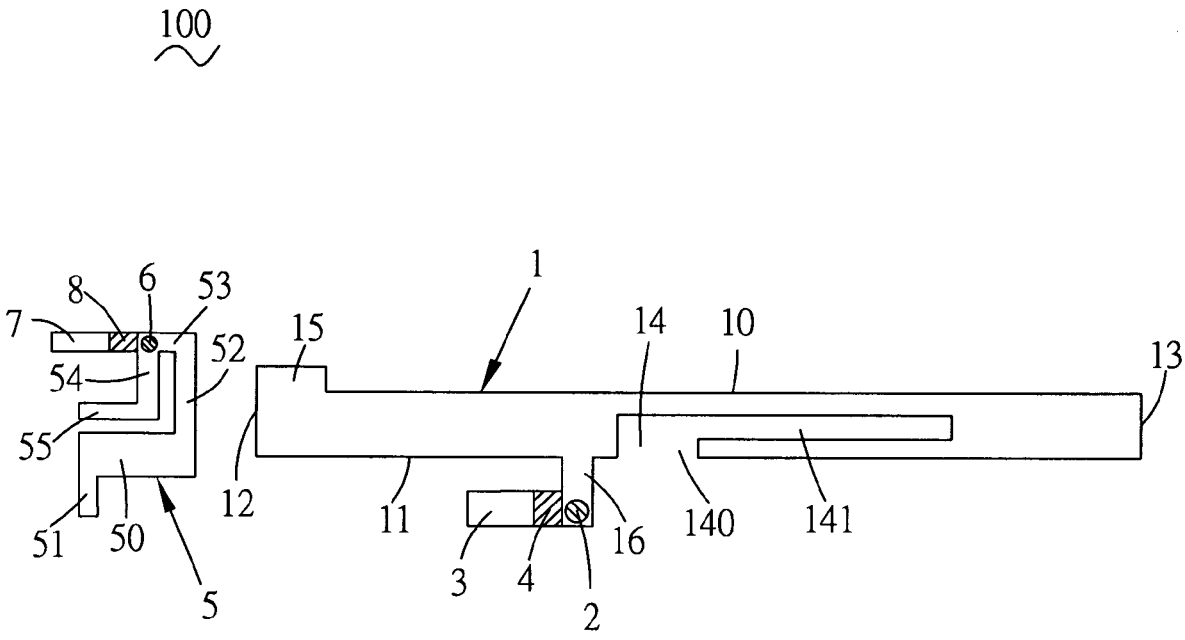
FIG. 1 shows the a preferred embodiment of the structure of an integrated multi-band antenna according to the present invention.

Please refer to FIG. 1, showing a preferred embodiment of an integrated multi-band antenna 100 according to the present invention. The integrated multi-band antenna 100 is made of metallic substances for example, making from a metal foil, printing on a printed circuit board, etc. The integrated multi-band antenna 100 has a first radiating element 1 and a second radiating element 5 spaced from the first radiating element 1.

In this case, the first radiating element 1 is a monopole antenna. The first radiating element 1 is substantially formed an elongated shape defining a first edge 10, a second edge 11 opposite to the first edge 10, a first end 12 and a second end 13 opposite to the first end 12. The first radiating element 1 has a slot 14 opened at the second edge 11 thereon. The slot 14 has an opening portion 140 opened at the second edge 11 of the first radiating element 1 and an extension portion 141 being extended from the close end of the opening portion 140. In this case, the wide range of the opening portion 140 is shorter than the length of the extension portion 141.

A protrusion 15 is arranged at the first end 12 of the first radiating element 1. In this case, the protrusion 15 projects from the first edge 10 of the first radiating element 1. A feeding conductor 16 extends from the second edge 11 of the first radiating element 1. The feeding conductor 16 is arranged to close to the opening portion 140 of the slot 14. A first feeding point 2 is arranged at the free end of the feeding conductor 16. A first ground portion 3 is spaced from the feeding conductor 16. In this case, the first ground portion 3 is arranged to close to the feeding conductor 16. In a further embodiment, the integrated multi-band antenna 100 has a first matching circuit 4 which electronically connects the first feeding point 2 and the first ground portion 3.

The first element 1 is divided into a first portion with the slot 14 and a second portion, seem from the feeding conductor 16. In this embodiment, the first portion obtains an electrical resonance length of a quarter wavelength corresponding to a low frequency band having GSM850 and EGSM900 bands. The second portion obtains an electrical resonance length of a quarter wavelength corresponding to a high frequency band having DCS1800, PCS1900 and W-CDMA2100 bands.

Still referring to FIG. 1, the second radiating element 5 is also a monopole antenna in this embodiment. The second radiating element 5 includes a first radiating segment 50 defined opposite sides, a second radiating segment 51 extending from one end of the first radiating segment 50, and a radiating strip section which has a third radiating segment 52, a fourth radiating segment 53, a fifth radiating segment 54 and a sixth radiating segment 55 connecting end to end in sequence wherein one end of the third radiating segment 52 connects to the other end of the first radiating segment 50, and one end of the sixth radiating segment remains free. Respectively an angle which is formed where the first radiating segment 50 connects the second and third radiating segments 51, 52, where the fourth segment 53 connects the third and fifth radiating segments 52, 54 and where the fifth segment 54 connects the sixth segment 55.

In this case, the second radiating segment 51 and the third radiating segment 52 are perpendicular to the first radiating segment 50 respectively, which extend from opposite sides of the first radiating segment 50. The third radiating segment 52 and the fifth radiating segment 54 are arranged to stand side by side. The fourth radiating segment 53 is perpendicular to the third radiating 52 and the fifth radiating segment 54 respectively.

Also, the first radiating segment 50 and the sixth radiating segment 55 are arranged to stand side by side. The width of the first radiating segment 50 is wider than other radiating segments 51, 52, 53, 54, 55 of the second radiating element 5. The width of the radiating segments 51, 52, 53, 54, 55 of the second radiating element 5 is almost the same except the width of the first radiating segment 50 of the second radiating element 5. The distance between the third radiating segment 52 and the fifth radiating segment 54 and the distance between the first radiating segment 50 and the sixth radiating segment 55 are almost the same.

The third radiating segment 52 of the second radiating element 5 is arranged to correspond to the first end 12 of the first radiating element 1. A second feeding point 6 is arranged at the corner where the fourth radiating segment 53 connects to the fifth radiating segment 54. A second ground portion 7 is spaced from the corner where the fourth radiating segment 53 connects to the fifth radiating segment 54. In this case, the second ground portion 7 is arranged to close to the corner where the fourth radiating segment 53 connects to the fifth radiating segment 54. In further embodiment, the integrated multi-band antenna 100 includes a second mating circuit 8 which electronically connects the second feeding point 6 and the second ground portion 7.

In this embodiment, the length from the second feeding point 6 to the free end of the sixth radiating segment 55 of the second radiating element 5 is a quarter of the wavelength corresponding to Wi-Fi5.2 GHz and the length from the second feeding point 6 to the free end of the second radiating segment 51 of the second radiating element 5 is a quarter of the wavelength corresponding to Wi-Fi2.4 GHz.

Figure 2:
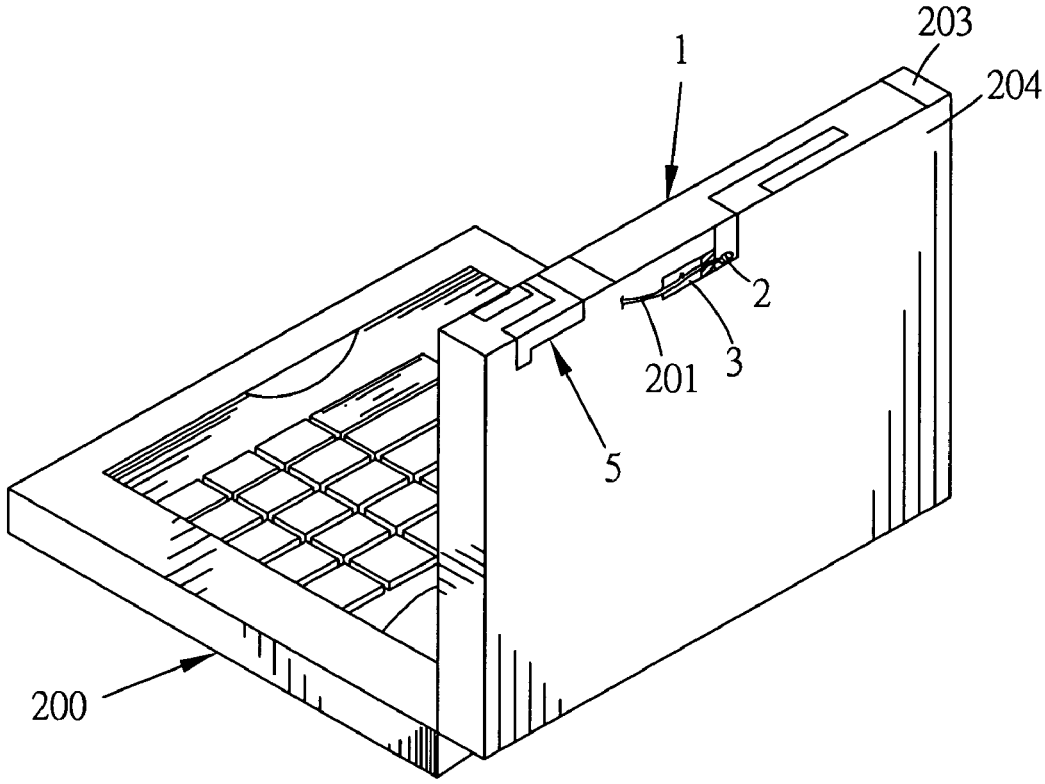
FIG. 2 is a perspective view showing the preferred embodiment of the integrated multi-band antenna folded to configure in a back surface of a display of a notebook.
Figure 3:
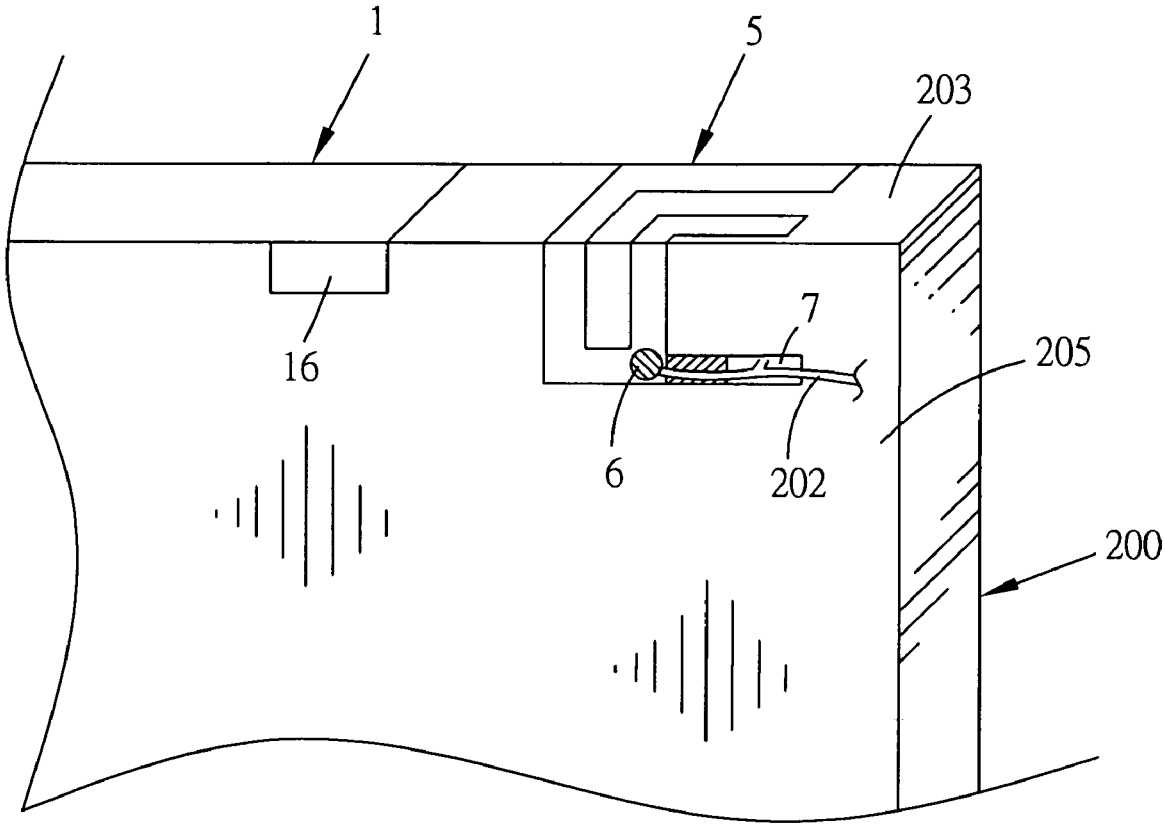
FIG. 3 is a perspective view showing the preferred embodiment of the integrated multi-band antenna folded to configure in a front surface of the display of the notebook.

As shown in FIG. 2 and FIG. 3. The first and second radiating elements 1, 5 of the integrated multi-band antenna 100 are folded to fit a housing configured in an electrical device 200. The electrical device 200 operates the integrated multi-band antenna 100 through a first cable 201 connected the first feeding point 2 and the first ground portion 3, and a second cable 202 connected the second feeding point 6 and the second ground portion 7. The first and second radiating elements 1, 5 are substantially located on a first surface of the housing except the first and second feeding points 2, 6 which are located on different surfaces of the housing for preventing first signal transmitting through the first cable 201 interfering with second signal transmitting through the second cable 202.

In this case, the electrical device 200 is a notebook and the housing is configured in a display of the notebook. The first and second radiating elements 1, 5 are substantially located on a top surface 203 of the display of the notebook 200. The first feeding point 2 is located on a back surface 204 of the display of the notebook 200. The second feeding point 6 is located on a front surface 205 of the display of the notebook 200.

According to the position where the feeding conductor 16 connects the first radiating element 1 and designed the slot 14, the first radiating element 1 has the low frequency band including GSM850 and EGSM900 bands, and the high frequency band including DCS1800, PCS1900 and W-CDMA2100 bands. Because the slot 14 obtains a high harmonic frequency partially overlapped the high frequency band, the bandwidth of the high frequency band of the first radiating element 1 can be enhanced.

According to the position where the second feeding point 6 arranged at the corner between the fourth radiating segment 53 and the fifth radiating segment 54, the second radiating element 5 obtains Wi-Fi2.4 GHz and Wi-Fi5.2 GHz bands. According to the relation position between the first radiating element 2 and the second radiating element 3, the integrated multi-band antenna 100 obtains a preferred pattern gain and a preferred high frequency bandwidth and low frequency bandwidth.

Furthermore, the present invention is not limited to the embodiments described above; various additions, alterations and the like may be made within the scope of the present invention by a person skilled in the art. For example, respective embodiments may be appropriately combined.

What is claimed is:

1. An integrated multi-band antenna comprising:

a first radiating element defining a first edge, a second edge opposite to said first edge, a first end and a second end opposite to said first end, and comprising a slot having an opening portion opened at said second edge thereon and an extension portion being extended from the close end of said opening portion and to said second end, a feeding conductor extending from said second edge and being arranged to close to said opening portion, a first feeding point arranged at said feeding conductor, a protrusion being arranged at said first end;

a second radiating element spaced from said first radiating element, and having a first radiating segment defined opposite sides, a second radiating segment extending from one end of said first radiating segment, a third radiating extending from the other end of said first radiating segment, said second and third radiating segments extending from opposite sides of said first radiating segment and perpendicular to the first radiating segment respectively, a fifth radiating segment and said third radiating segment being arranged to stand side by side, a fourth radiating segment connecting to said third and fifth radiating segments, a sixth radiating segment extending from the free end of said fifth radiating segment, said first and sixth radiating segments being arranged to stand side by side, a second feeding point arranged at a corner where said fourth radiating segment connecting said fifth radiating segment;

a first ground portion spaced from said feeding conductor of said first radiating element; and a second ground portion spaced from said corner where said fourth radiating segment connects said fifth radiating segment.

2. The integrated multi-band antenna as claimed in claim 1, wherein the width of said opening portion of said slot is shorter than the length of said extension portion of said slot.

3. The integrated multi-band antenna claimed in claim 1, wherein said first feeding point is arranged at the free end of said feeding conductor.

4. The integrated multi-band antenna claimed in claim 1, wherein said protrusion extends from said first edge of said first radiating element.

5. The integrated multi-band antenna as claimed in claim 1, wherein the width of the first radiating segment is wider than other radiating segments of said second radiating element, the width of said radiating segments of said second radiating element is the same except the width of said first radiating segment of said second radiating element.

6. The integrated multi-band antenna as claimed in claim 1, wherein the distance between said first and sixth radiating segments and the distance between said third and fifth radiating segments are the same.

7. The integrated multi-band antenna as claimed in claim 1, wherein said first end of said first radiating element is arranged to correspond to said third radiating segment of said second radiating element.

8. The integrated multi-band antenna as claimed in claim 1, further comprising a first matching circuit electronically connecting said first feeding point and said first ground portion, a second matching circuit electronically connecting said second feeding point and said second ground portion.

9. The integrated multi-band antenna as claimed in claim 1, wherein said first and second radiating elements are folded to fit a housing configured in an electrical device, said first and second radiating elements substantially located on a first surface of said housing except said first and second feeding points, which are located on different surfaces of said housing respectively.

10. An integrated multi-band antenna comprising:

a first monopole antenna defining a first end, a second end opposite said first end, a first edge and a second edge opposite to said first edge, and having a slot opened at said second edge thereon and being extended to said second end, a feeding conductor arranged to close to the opening of said slot;

a first feeding point arranged at said feeding conductor;

a first ground portion spaced from said feeding conductor;

a second monopole antenna being arranged spaced from said first monopole antenna, and having a first radiating segment defined opposite sides, a second radiating segment extending from one end of said first radiating segment, a radiating strip section connecting to the other end of said first radiating segment, said radiating strip section having a third, a fourth, a fifth and a sixth radiating segments which are segmented in order, respectively an angle which is formed where said first radiating segment connects said second and third segments, where said fourth segment connects said third and fifth segments and where said fifth segment connects said sixth segment;

a second feeding point arranged at a corner where said fourth radiating segment connects said fifth radiating segment; and a second ground portion spaced from said corner.

11. The integrated multi-band antenna as claimed in claim 10, wherein said slot has an opening portion opened at said second edge of said first radiating element and an extension portion being extended from the close end of said opening portion and to said second end of said first radiating element, the width of said opening portion is shorter than the length of said extension portion.

12. The integrated multi-band antenna as claimed in claim 10, wherein a protrusion is arranged at said first end of said first radiating element, said protrusion projects from said first edge of said first radiating element.

13. The integrated multi-band antenna as claimed in claim 10, wherein said second and third radiating segments extend from opposite sides of said first radiating segment, said third and fifth radiating segments are arranged to stand side by side, said first and sixth radiating segments are arranged to stand side by side.

14. The integrated multi-band antenna as claimed in claim 13, wherein the width of said first radiating segment is wider than other radiating segments of said second radiating element, the width of said radiating segments of said second radiating element is the same except the width of said first radiating segment of said second radiating element, the distance between said first and sixth radiating segments and the distance between said third and fifth radiating segments are the same.

15. The integrated multi-band antenna as claimed in claim 10, further comprising a first matching circuit electronically connecting said first feeding point and said first ground portion, a second matching circuit electronically connecting said second feeding point and said second ground portion.

16. The integrated multi-band antenna as claimed in claim 10, wherein said first and second radiating elements are folded to fit a housing which is configured in an electrical device, said first and second radiating elements substantially located on a first surface of said housing except said first and second feeding points which are located on different surfaces of said housing.

17. The integrated multi-band antenna as claimed in claim 10, wherein said third radiating segment of said second radiating element is located to correspond to said first end of said first radiating element.

18. An antenna comprising:

a first radiating segment defining opposite sides;

a second radiating segment extending from one end of said first radiating segment;

a third radiating segment extending from the other end of said first radiating segment, said second and third radiating segments extending from opposite sides of said first radiating segment respectively;

a fifth radiating segment arranged to correspond to said third radiating segment and connecting said third radiating segment through a fourth radiating segment;

a sixth radiating segment extending from the free end of said fifth radiating segment and being arranged to correspond to said first radiating segment, respectively an angle which is formed where said first radiating segment connects said second and third segments, where said fourth segment connects said third and fifth segments and where said fifth segment connects said sixth segment;

a feeding point arranged at the corner where said fourth radiating segment connects said fifth radiating segment; and a ground portion spaced from said corner.

19. The antenna as claimed in claim 18, wherein the width of said first radiating segment is wider than other radiating segments, the width of said radiating segments is the same except the width of said first radiating segment, the distance between said first and sixth radiating segments and the distance between said third and fifth radiating segments are the same.

20. The antenna as claimed in claim 18, further comprising a matching circuit connecting said feeding point and said ground portion.

* * * * *